United States Patent [19]

Nicolo

[11] Patent Number: 4,551,963

[45] Date of Patent: Nov. 12, 1985

[54] AUTOMATIC SEPARATOR DEVICE FOR FILLING BOXES WITH TUBES

[75] Inventor: Pierfrancesco Nicolo, Sordevolo, Italy

[73] Assignee: C.M.T. San Grato S.r.l., Sordevolo, Italy

[21] Appl. No.: 393,152

[22] Filed: Jun. 28, 1982

[51] Int. Cl.[4] ..... B65B 19/34

[52] U.S. Cl. ..... 53/148; 53/251; 53/263; 53/534

[58] Field of Search ..... 53/263, 248, 534, 148, 53/236, 251; 198/425; 271/DIG. 10, 214, 294, 295

[56] References Cited

U.S. PATENT DOCUMENTS

| | | | |
|---|---|---|---|
| 906,291 | 12/1908 | Robb | 53/263 |
| 3,199,264 | 8/1965 | Dietmann | 53/263 |
| 3,324,622 | 6/1967 | Schmermund | 53/236 |
| 3,481,108 | 12/1969 | Englander et al. | 53/534 |
| 3,805,476 | 4/1974 | Kawamura et al. | 53/534 X |
| 3,872,647 | 3/1975 | Langen et al. | 198/425 X |

*Primary Examiner*—John Sipos
*Assistant Examiner*—Donald R. Studebaker
*Attorney, Agent, or Firm*—Guido Modiano; Albert Josif

[57] ABSTRACT

The device comprises sets of paddles hinge connected at preset distances from one another to closed loop entrainment chains, rotatively mounted around a drum, on the exterior thereof, for discharging tubes into individual boxes which are arranged on an intermittently operated feeding belt moving beneath said discharge drum, there being further provided control means for controlling the intermittent feeding movement of said paddle entrainment means synchronously with the box feeding means, thereby the paddles in each set are caused to progressively enter a box during the final stroke thereof into a position underlying the discharge drum, and then stay within the box during the time when the latter's bins are being filled in succession, and lastly progressively move out of the box upon completion of the filling step.

5 Claims, 7 Drawing Figures

28
13
9
28
21
23c
25
6
29
28
5
23b
23
22c
21a
15
23a
16
22
21b
22b
22a
20
21c
19
18

28
25
13
9
24c
23
28
6
29
5
28
22c
21
15
17
16
21c
18
22
20
19

28
13
28
22c
25
28
24
9
29
6
5
22
16
17
15
24c
20
19
18

AUTOMATIC SEPARATOR DEVICE FOR FILLING BOXES WITH TUBES

BACKGROUND OF THE INVENTION

This invention relates to an automatic separator device of the paddle type for temporary dividing boxes into bins while being filled with spinning and twisting tubes.

Known in the art are paddle devices associated with automatic machines for orderly rearranging and loading spinning tubes into collecting boxes, which have the function of temporarily dividing the box interior volume into bins while the box is being filled, such as to prevent the tubes, which are fed from a feeding roller oriented in one and the same direction, from turning over and arranging themselves crosswise during the box filling step. In particular, known are paddle separators which comprise a frame carrying paddles rigidly spaced apart from one another, which frame is manually applied to the box and then withdrawn, again manually, after the filling step has been completed.

Also known is a rigid paddle separator device which can be inserted into and withdrawn from the box, upon completion of the filling step, by a turnable arm linkage capable of carrying out, in accordance with a preset sequence and automatically, said frame inserting and withdrawing operations.

Of course, manually operated separator devices have in practice the disadvantage of requiring the availability of labor personnel, and of involving high manufacturing and inventory costs as a result from the necessity of keeping a number of devices available, whilst the mechanically operated devices are of complex construction, large bulk size, and involve considerable downtime for their actuation during the insertion and withdrawal steps into/from the box.

SUMMARY OF THE INVENTION

It is, therefore, an object of this invention to provide a paddle-type separator device for boxes to be filled with tubes, which can obviate the drawbacks affecting conventional devices, and above all which can operate automatically at a high rate of operation, and is highly reliable and, hence, affords a high hourly output rate.

A further object of the invention is to provide a separator device of the type indicated, which is so constructed as to be suitable, by a simple substitution of the paddle number and size, for filling boxes of any sizes, as well as for association with any conventional filling machine utilizing a grooved tube discharging roller or equivalent device.

These and other objects, such as will be apparent from the detailed description with follows, are achieved by a separator device for filling boxes with spinning tubes, being of the type equipped with paddles or plates adapted to temporarily divide the boxes into bins during the filling thereof, comprising sets of paddles hinge connected at preset distances from each other to endless entrainment means rotatively mounted around the tube discharging drum on the exterior thereof for discharging said tubes into individual boxes arranged onto intermittently operated means of feeding said boxes beneath said discharging drum, driving means being further provided for intermittently feeding said paddle entrainment means in synchronization with said box feeding means, thereby causing the paddles in each set to progressively enter a box during the final stroke thereof into a position underlying said discharge drum and then stay within said box during the time when said bins are being filled in succession, and lastly progressively move out of said box upon completion of the bin filling step.

More specifically, said paddle set entrainment means preferably comprises a pair of chains, arranged in an endless or closed loop configuration and run over sprockets set for rotation about parallel axes to the axis of said discharging drum, each paddle hinged to said chains being provided with at least one shoe element projecting transversely out of the paddle plane and being adapted to rest onto a fixed surface located under said discharging drum, thereby each set of paddles, when inserted into a box during the filling operation, has its paddles in a steady position and arranged parallel to one another in a vertical direction.

BRIEF DESCRIPTION OF THE DRAWINGS

The invention will be next described in more detail, with reference to a preferred non-limitative embodiment thereof and to the accompanying drawings, given herein by way of example and not of limitation, where.

DESCRIPTION OF THE PREFERRED EMBODIMENT

Figure 1:
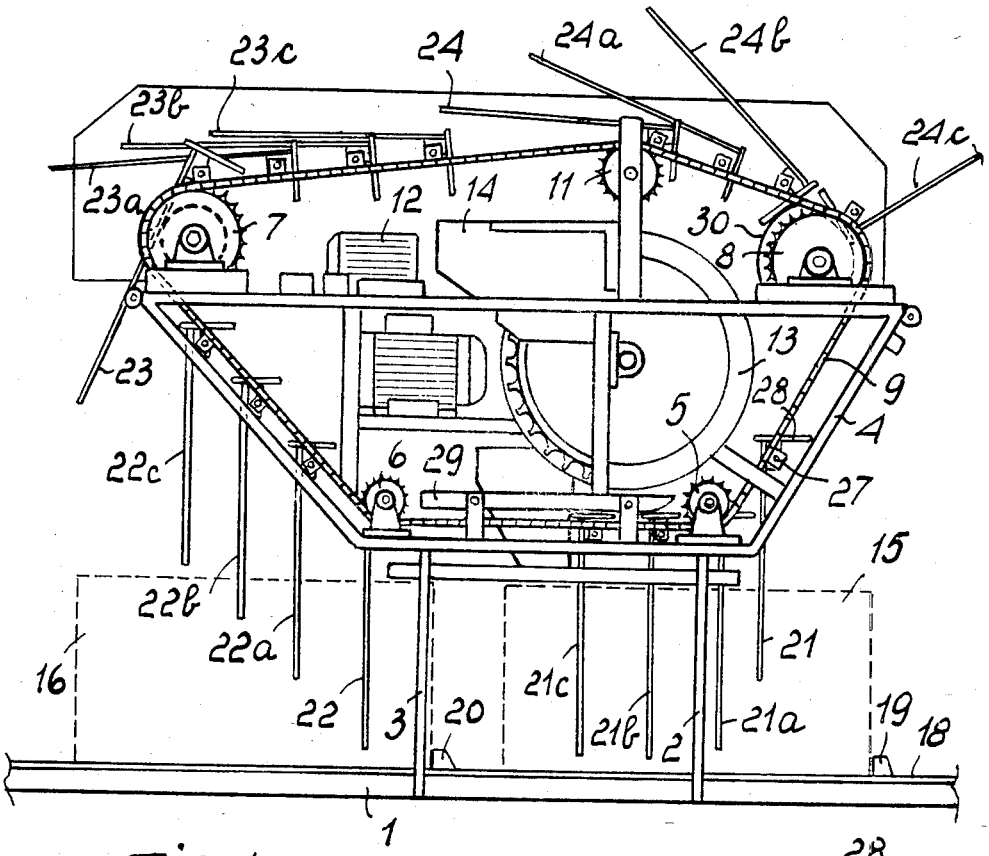
FIG. 1 shows schematically a side view of a separator device for tube boxes according to the invention.

With reference to the drawing figures, and in particular to FIGS. 1 to 4, the separator or transfer device according to this invention comprises a flat base 1 carrying, through two opposite pairs of uprights 2 and 3, two identical trapezoidal frames 4, extending parallel to each other, which define two vertical side members rigidly interconnected by means of intermediate cross-pieces. To each trapezoidal side member 4, there are keyed, at the bottom thereof, two sprocket wheels 5-6, and at the top thereof, two further sprocket wheels 7-8. The rotation axes of the sprockets 5-6 are parallel to each other and extend in a horizontal plane parallel to the plane of the base 1; in a similar manner, the sprockets 7-8 have their axes parallel and lying on a horizontal plane, although this condition may be unnecessary in actual practice.

Figure 2:
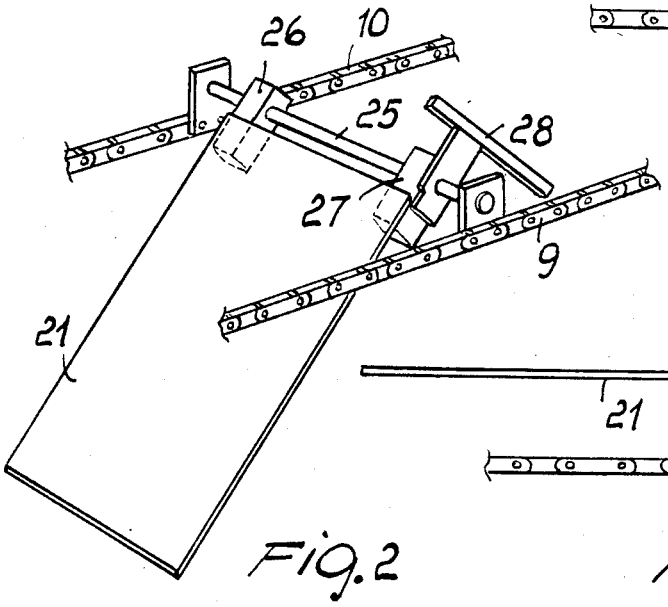
FIG. 2 is a perspective view of a paddle secured to the drive chains, as provided in the device of FIG. 1.
Figure 3:
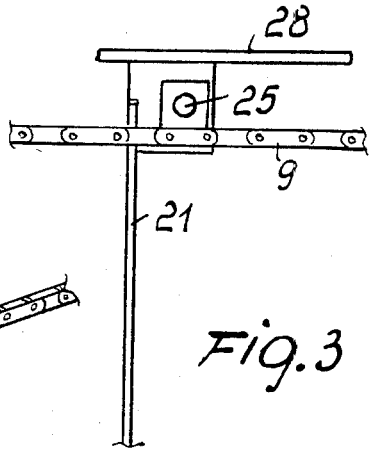
FIGS. 3 and 4 are detail side views, respectively of a paddle extending perpendicularly to the drive chains, and of that same paddle as rotated to extend parallel to the drive chains.
Figure 4:
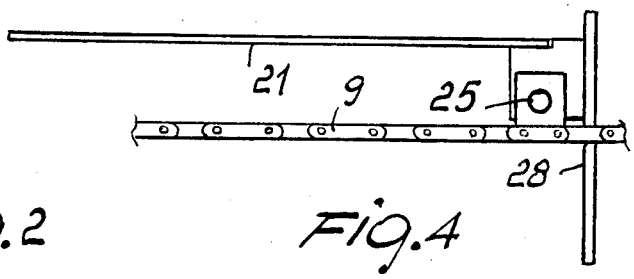

Around the four sprocket wheels in each side member, there is passed a chain 9, respectively 10, (FIG. 2). The upper run or stringer of the chains is deflected by an additional sprocket wheel 11, set for idle rotation, which is provided to set an apex for the chains, whose function will be explained hereinafter.

With said arrangement, the run of each chain which extends between the sprockets 5-6 is horizontal, and accordingly, parallel to the base. The chains 9-10 are driven by a separate motor, e.g. a motor 12, which can drive in any desired conventional way one sprocket, e.g. the sprocket 7, of each chain. Arranged between the two side members is a grooved roller or drum 13, of conventional design, which is adapted to discharge metered quantities of tubes, the latter being fed from a hooper 14 into the grooves of the roller or drum 13. As best visible in FIG. 1, the grooves or the drum 13 are in the form of elongated containment formations extending parallel to the horizontal axis of the drum. The hooper 14 is associated with a rearranging machine, of a known type and not shown. From the drum 13 the tubes are loaded into boxes 15-16-17, etc. The boxes are intermittently brought under the discharge roller 13 by a conveyor belt 18, placed on the base 1. Blocks 19,20, etc., fastened to the conveyor belt 18, cause the boxes to move forward.

To the chains 9-10, at preset intervals relatively to the positions of the boxes onto the belt 18, there are hinged sets of paddles, which are formed from aluminum or another suitable material, the number and dimensions of the individual paddles being effective to suit the size and shapes of the boxes to be filled.

FIG. 1 shows four sets of four paddles each, indicated at **21-21*a*-21*b*-21*c*, 22-22*a*-22*b*-22*c*, 23-23*a*-23*b*-23*c*, and 24-24*a*-24*b*-24*c***.

Each paddle, as shown in FIG. 2, is hinge connected between the two chains 9-10 by means of a shaft 25, on which two prismatic tilting blocks 26-27 are mounted which are rigid with the paddle 21. By virtue of the hinged connection, those paddles which are located on the two sloping runs of the trapetium formed by the drive chains are enabled to arrange themselves perpendicularly and parallel to one another, whereas the paddles in the sets 23 and 24 are allowed to fold by gravity one upon the other, with the advantage of reducing the bulk size of the device as a whole.

With each block 27 of each paddle (or with both blocks) there is associated a shoe 28 which comprises a strip extending perpendicularly to the paddle plane (FIGS. 2-3-4) and projecting rearwardly to the paddle itself. The shoe serves the function of providing a steady support means against a fixed surface 29 (FIG. 1) which is located horizontally beneath the discharge roller 13, such that the paddles, upon entering a box, can occupy a stable position and create rigid bins within the box itself.

As mentioned hereinabove, at the top run or stringer of each chain a deflecting sprocket 11 is provided which serves to create a slope in the chains between the sprocket 11 and sprocket 8, forming a lead-in for the paddles, such as the paddles **24-24*c* of FIG. 1, to gradually raise from the superimposed position which they occupy prior to running past the sprocket 11, until their hinge connection area reaches the sprocket 8. In order to prevent at this time in this transition region the paddles from tilting sharply over about the sprocket 8 prior to occupying a vertical position, an eccentric wheel 30 (FIG. 1) is provided, which is mounted coaxially with the sprocket wheel 8, and has its lobe in contact with the shoe 28 as the paddle approaches the sprocket 8; thus, it will form for the paddle a circular guide which prevents the paddle (as hinged to the chain) from turning over; along the downward slope of the lobe of the wheel 30, the paddle is gradually moved down, while being guided, until the shoe 28** disengages from the eccentric wheel and leaves the paddle free to gently take its upright position.

Figure 5:
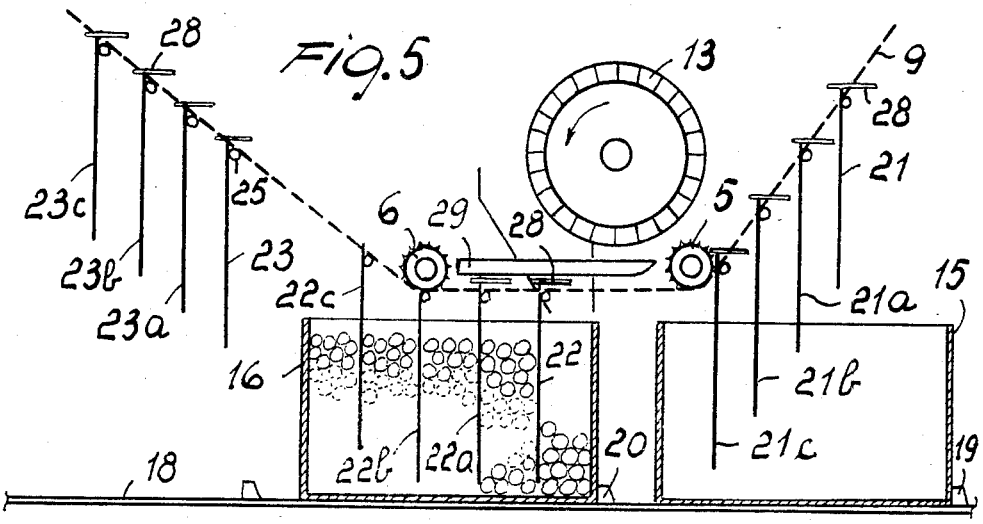
FIG. 5 illustrates schematically a portion of the device of FIG. 1, and specifically the arrangement of one set of paddles into a box during the last bin discharging step and the progressive entering of an oncoming box by the following set of paddles.
Figure 6:
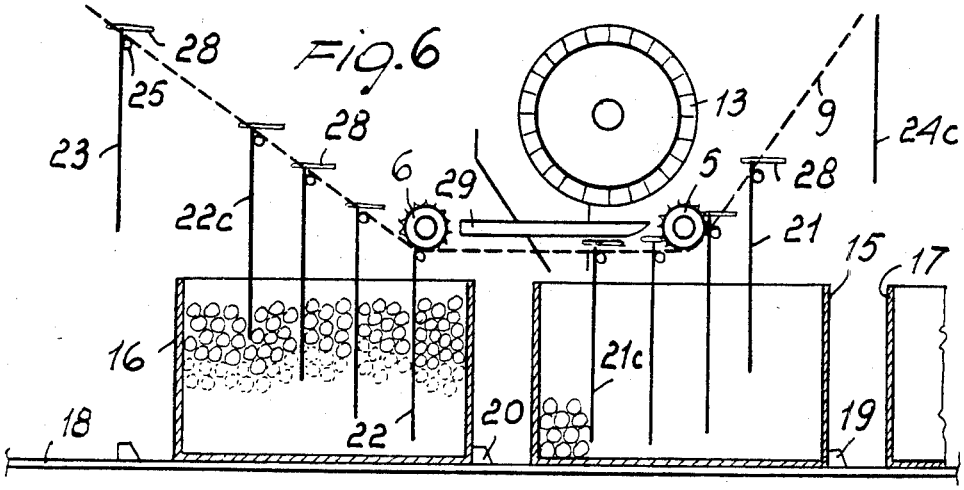
FIG. 6 shows, again schematically, a filled box with the paddles being withdrawn from it and a box being loaded at the first bin.

The operation of the device just described will be briefly discussed herein below with reference to FIGS. 5-6-7. Assuming that the device is in operation, with the chains running in a clockwise direction and the boxes being fed from right to left as viewed in the figures, still within the box 16 (FIG. 5) are the paddles **22-22*c*, and the last bin is being filled while, moving progressively into the box 15, are the paddles 21*c*-21*b*-21*a*-21. As the discharge roller 13 completely fills the last bin in the box 16, the conveyor belt moves all the boxes to the right, through the respective blocks 19-20, etc; the box 15 is moved toward the roller 13 until it interferes with a photocell (not shown), which actuates the chain movements; the paddles 21-21*c*, through a microswitch or other conventional sensor, are brought under the roller 13 and locked rigidly in an upright position within the box by virtue of their shoe 28 coming to rest onto the fixed surface 29. From the hopper 31 are unloaded a metered number of tubes which fill the first bin in the box 15 (FIG. 6); after said first bin has been filled, the box 15 is moved again to permit the next bin to be filled. Thus, while the box 15 is being filled, the paddles 22-22*c* are gradually drawn out of the previously filled box 16**.

Figure 7:
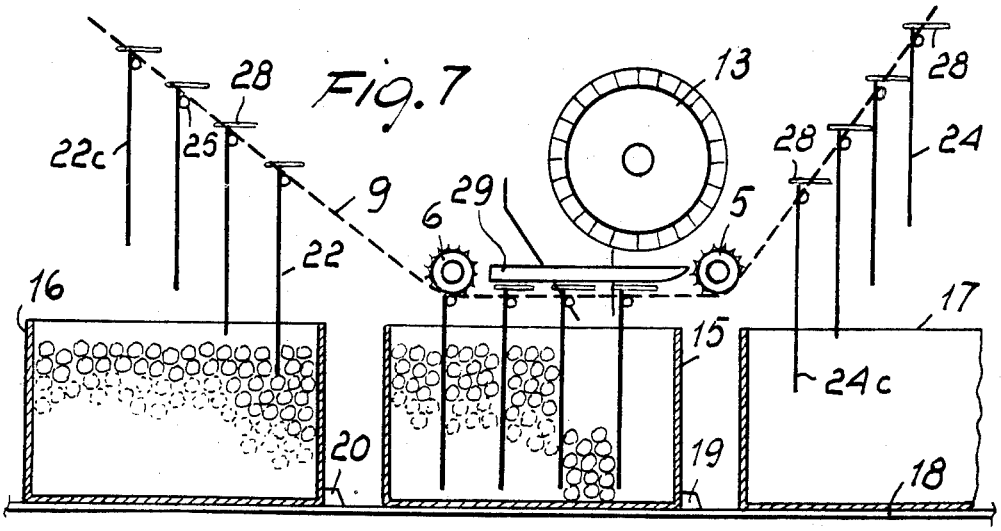
FIG. 7 shows a filled box with the paddles moved out of it, a box being loaded, and another oncoming box.

FIG. 7 shows a box 15 while its last but one bin is being filled, all of the paddles being inserted into the box, whereas the paddles **22-22*c* are almost all withdrawn from the box 16**.

It will be appreciated from the foregoing that the arrangement of swivelling chain-guided paddle sets in a closed loop configuration affords in practice a high hourly output, in a most reliable way and without resorting to labor power.

The device is provided with timer and/or sensor actuating means of conventional design, which are all connected to a control unit, not shown because foreign to this invention.

Of course, modifications and variations, constructionwise and functionally equivalent, may be introduced in the preferred but not limitative embodiment of the invention described hereinabove, without departing from the invention scope.

I claim:

1. An automatic transfer device for filling tubular bodies in parallel arrangement into boxes carried by a conveyor unit, comprising a drum-like member arranged above said conveyor unit for rotation around a substantially horizontal rotation axis, said drum-like member having an outer peripheral surface parallel to said rotation axis, said outer peripheral surface having peripheral containment formations extending parallel to each other and to said rotation axis for receiving therein and transferring therefrom said tubular bodies into said boxes, while maintaining said tubular bodies in a substantially horizontal position, endless entrainment means extending around said drum-like member at a distance therefrom and lying in a plane transverse to said horizontal rotation axis, said entrainment means comprising a pair of parallel chains in endless loop configuration each defining an upper stringer extending substantially above said drum-like member and a lower stringer extending substantially underneath and laterally to said drum-like member and inclined stringers connecting said first and second stringers, the chains of said pair of chains extending parallel at a distance from each other, a set of paddles hingedly connected on and between said chains for freely hanging by gravity vertically downwards from said lower stringers and for pivoting over each other at said upper stringers of said parallel chains, support members rigid with said paddles at a peripheral edge thereof, each of said paddles having a hinge mechanism defining a hinge axis extending parallel to said horizontal axis through said support member, each of said paddles having near said support members at least one shoe element rigid therewith in the form of a bar extending transverse to said paddles, means for pivoting said paddles as they move onto said upper stringer, motor means for moving said entrainment means in synchronization with and with said lower stringer chain in the direction of said flat conveyor unit, thereby said vertically hanging paddles at said lower stringer of said parallel chains progressively entering said boxes for dividing said boxes into temporary bins formed between consecutive vertically hanging paddles, each said bin being progressively advanced under said drum-like member untill completion of filling with said tubular bodies, said vertically hanging paddles being progressively removed from said boxes after completion of said filling and pivoting over each other when reaching said upper stringer position.

2. An automatic transfer device according to claim 1, wherein said chain driving means comprise rotatable guide sprockets having a rotation axis extending parallel to said horizontal rotation axis of said drum-like member.

3. An automatic transfer device according to claim 1, comprising further a stationary horizontal surface arranged between said drum-like member and said lower stringer of said entrainment means for engaging said shoe elements of the paddles and maintaining said paddles in a vertical position.

4. An automatic transfer device according to claim 1 further comprising at least one entrainment sprocket arranged at a transition region between said upper stringer and said lower stringer in which said paddles are in a tilted position with respect to the pivoting position to the freely hanging position, said entrainment sprocket having a rotation axis, comprising further a cam wheel mounted on said entrainment wheel in offset position to said rotation axis of said entrainment wheel for engaging said shoe elements of said paddles and causing a gradual tilting of said paddles.

5. An automatic transfer device according to claim 1, further comprising an entrainment sprocket arranged at a transition region between said upper stringer and said lower stringer in which said paddles are in a tilted position with respect to the pivoting position to the freely hanging position, and slope increasing sprockets arranged at a middle region of said upper stringer, said slope increasing sprocket being at a higher level than said entrainment sprocket thereby defining an upper stringer portion sloping downwards from said slope increasing sprockets to said entrainment sprocket in the advancing direction of said stringers.

* * * * *